US005927158A

United States Patent [19]

Lin

[11] Patent Number: 5,927,158

[45] Date of Patent: Jul. 27, 1999

[54] COMBINATION RATCHET WRENCH

[76] Inventor: Yuan-Ho Lin, No. 22, Chiao-Chien Rd., Chien-Min Li, Ta-Li City, Taichung Hsien, Taiwan

[21] Appl. No.: 09/039,416

[22] Filed: Mar. 16, 1998

[51] Int. Cl.[6] ..... B25B 13/46

[52] U.S. Cl. ..... 81/60; 81/61; 81/62

[58] Field of Search ..... 81/60, 61, 62, 81/63, 128, 129

[56] References Cited

U.S. PATENT DOCUMENTS 4,593,585 6/1986 Hurtig ..... 81/77

5,178,047 1/1993 Arnold et al. ..... 81/60

*Primary Examiner*—David A. Scherbel

*Assistant Examiner*—Sinclair Skinner

*Attorney, Agent, or Firm*—Bacon & Thomas, PLLC

[57] ABSTRACT

A combination ratchet wrench includes a work end at one end of a handle, a ratchet wheel mounted in the work end, a stop block forced by a spring and a ball into engagement with the ratchet wheel to limit the turning direction of the ratchet wheel for permitting the ratchet wheel to be turned with the handle in one direction to fasten up or loosen a workpiece, wherein the work end has a recessed polygonal hole remote from the handle, the recessed polygonal hole having two angled lateral side walls, and two smoothly arched side walls respectively extended from the angled lateral sides toward the handle; the ratchet wheel has an eccentric coupling rod at one side; a crank pivoted to one side of the ratchet wheel and partially projecting into the recessed polygonal hole for stopping an inserted workpiece in the recessed polygonal hole for turning with the wrench, the crank having a constraint block at one end moved with the crank in the recessed polygonal hole for stopping the inserted workpiece in the recessed polygonal hole.

5 Claims, 7 Drawing Sheets

COMBINATION RATCHET WRENCH

BACKGROUND OF THE INVENTION

The present invention relates to a hand tool, and more particularly to a combination ratchet wrench which comprises a recessed polygonal hole in a work end at one end of the handle thereof for securing any of a variety of workpieces, and a crank coupled to the ratchet wheel thereof and adjusted to stop the inserted workpiece in the recessed polygonal hole for turning with the wrench.

A regular ratchet wrench, as shown in FIG. 1, is comprised base frame which is formed of two symmetrical plastic plates connected together in a rack, two ratchet wheels mounted in holes at two opposite ends of the base frame, two pawl members respectively forced into engagement with the ratchet wheels, two springs mounted in a respective slots on the base frame, and two balls respectively supported on the springs and forced by the springs into close contact with pawl members to limit the turning direction of the ratchet wheels, and two double eye-end cover plates respectively covered on two opposite sides of the base frame. This structure of ratchet wrench can only turn workpieces of two particular sizes (one ratchet wheel for one particular size). Furthermore, the assembly process of this structure of ratchet wrench is complicated. If to add additional devices to the ratchet wrench in order to provide additional functions, the whole assembly of the ratchet wrench becomes heavy and huge.

SUMMARY OF THE INVENTION

The present invention has been accomplished to provide a combination ratchet wrench which eliminates the aforesaid drawbacks. According to one aspect of the present invention, the is one object of the present invention to provide a combination ratchet wrench which comprises a handle, a work end integral with one end of the handle, the work end defining a recessed chamber and a recessed polygonal hole, a ratchet wheel mounted in the recessed chamber, the ratchet wheel having a tool shaft extending out of the work end, a substantially triangular stop block mounted in the recessed chamber and forced into engagement with the ratchet wheel, a ball supported on a spring and forced by the spring into close contact with the stop block to limit the turning direction of the ratchet wheel, and a crank pivoted to the ratchet wheel and moved to adjust the working space of the recessed polygonal hole for securing any of a variety of workpieces for turning with the wrench. According to another aspect of the present invention, the crank has a smoothly curved constraint block at one end for stopping the inserted workpiece in the recessed polygonal hole. According to still another aspect of the present invention, the recessed polygonal hole comprises two angled lateral side walls, and two smoothly arched side walls respectively extended from the angled lateral sides toward the recessed chamber for guiding the movement of the crank in the recessed polygonal hole. According to still another aspect of the present invention, the stop block has two sets of teeth at the front side, each set of teeth including three teeth for positive engagement with the ratchet wheel.

DETAILED DESCRIPTION OF THE PREFERRED EMBODIMENT

Figure 1:
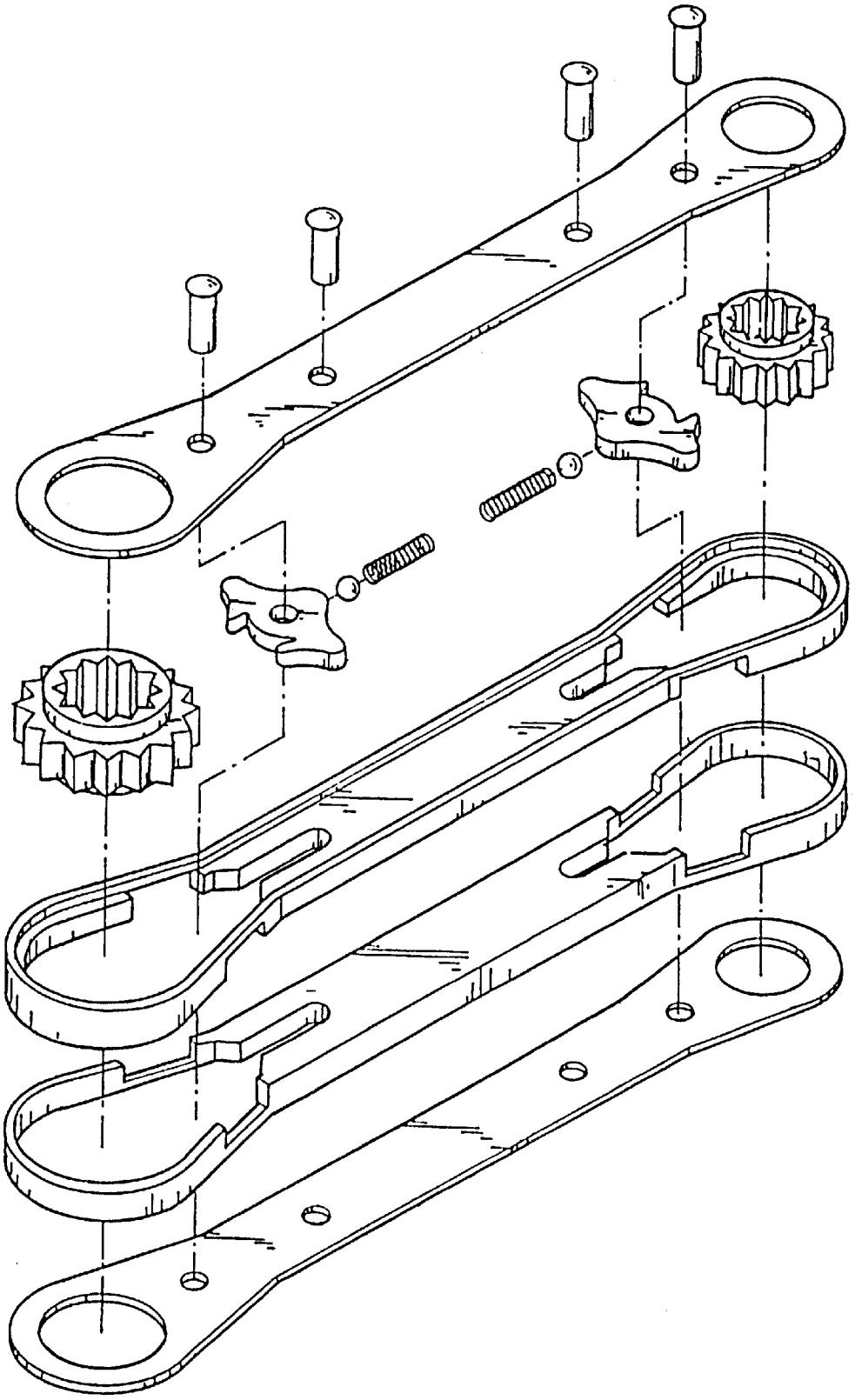
Fig·1 PRIOR ART
FIG. 1 is an exploded view of a ratchet wrench according to the prior art.
Figure 2:
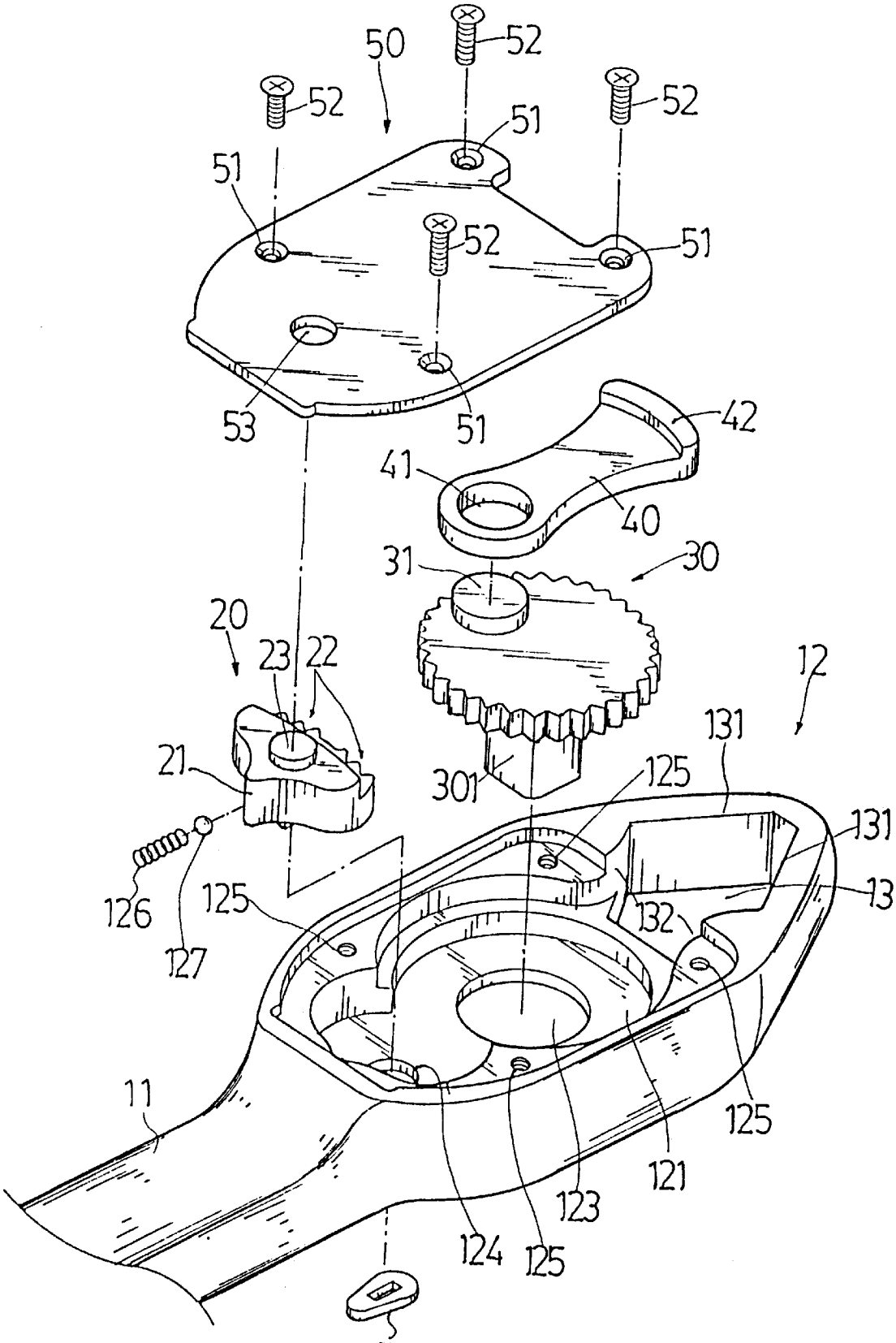
FIG. 2 is an exploded view of a combination ratchet wrench according to the present invention.
Figure 3:
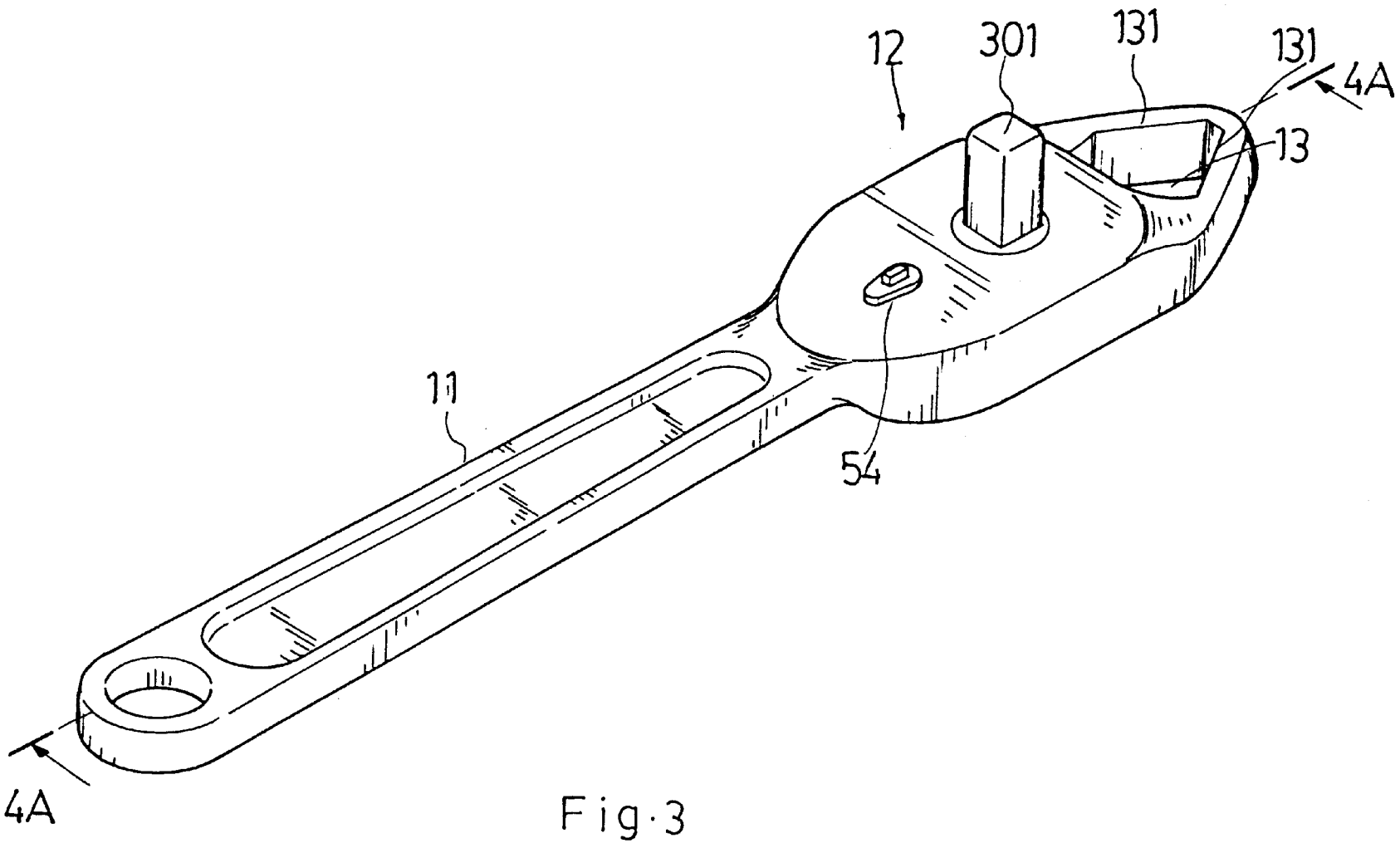
FIG. 3 is a perspective view of the present invention.
Figure 4A:
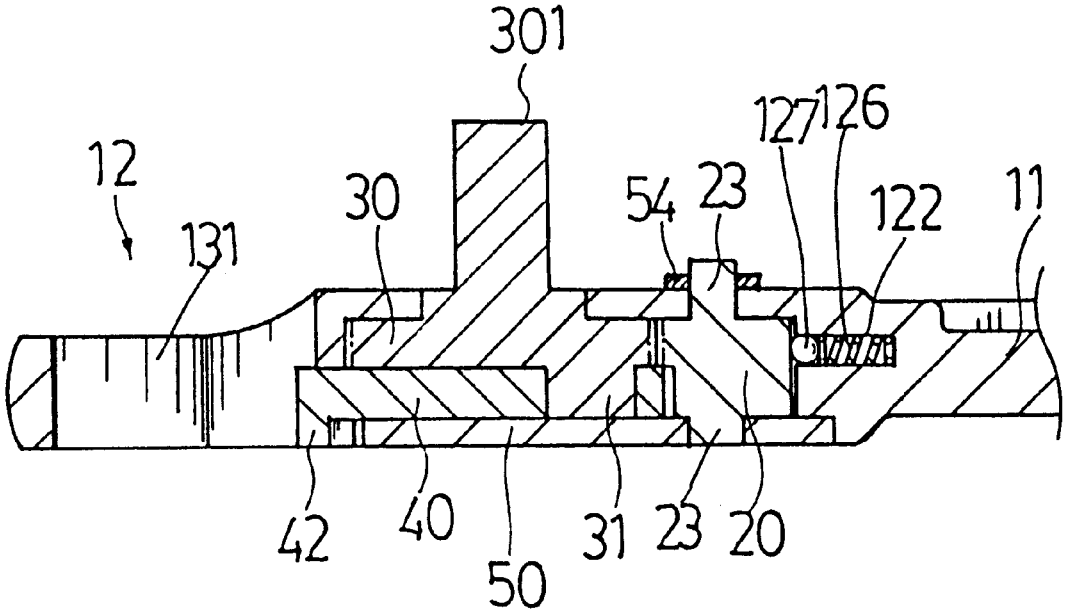
FIG. 4A is a sectional view of the present invention, showing the coupling rod of the ratchet wheel shifted to the bottom side.
Figure 4B:
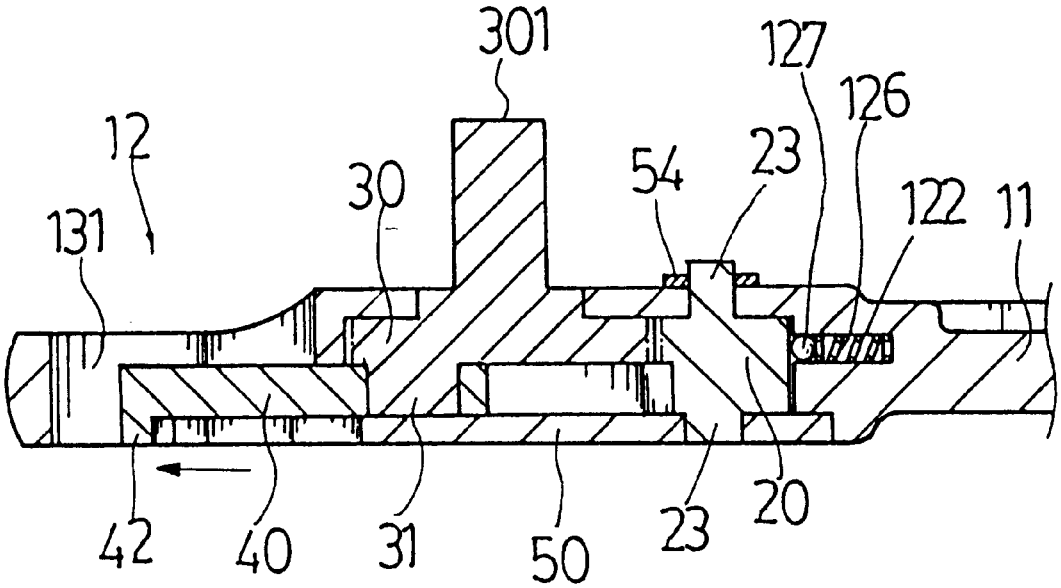
FIG. 4B is similar to FIG. 4A but showing the coupling rod of the ratchet wheel shifted to the top side.

Referring to FIGS. 2, 3, 4A and 4B, a combination ratchet wrench in accordance with the present invention comprises a handle 11 having one end terminating in an expanded, substantially oval-shaped work end 12. The work end 12 comprises a recessed chamber 121 shaped like "∞", a circular through hole 123 through the recessed chamber 121 remote from the handle 11, a small through hole 124 through the recessed chamber 121 adjacent to the handle 11, a blind hole 122 at the vertical peripheral wall of the recessed chamber 121 adjacent to the small through hole 124, a spring 126 mounted in the blind hole 122, a ball 127 supported on the spring 126 and partially projecting out of the blind hole 122, a plurality of screw holes 125 symmetrically disposed at two sides of the recessed chamber 121, and a recessed polygonal hole 13 at one end remote from the handle 11. The recessed polygonal hole 13 comprises two angled lateral side walls 131, and two smoothly arched side walls 132 respectively extended from the angled lateral sides 131. Each angled lateral side wall 131 includes two side wall sections of different length, and defines a 120° contained angle. A flat, triangular stop block 20 is mounted in the recessed chamber 121 and coupled to the small through hole 124. The stop block 20 comprises a constraint angle 21 raised from a back side thereof and disposed in contact with the ball 127 on the spring 126, two sets of teeth 22 bilaterally arranged at a front side thereof, and two vertical rods 23 respectively raised from top and bottom sides thereof at the center. One vertical center coupling rod 23 (which has a rectangular cross forced outwards by the spring 126 and stopped at one side of the constraint angle 21 of the stop block 20.

Referring to FIGS. 5A, 5B, 5C and 5D, by operating the finger plate 54 with the hand to turn the stop block 20 leftwards or rightwards, the contact area between the constraint angle 21 and the ball 127 is relatively changed, and the two sets of teeth 22 are alternatively forced into engagement with the ratchet wheel 30 to control clockwise or counter-clockwise idle run of the combination ratchet wrench. As illustrated, when the ball 127 is stopped at the right side of the constraint angle 21 of the stop block 20, the left set of teeth 22 of the ratchet wheel 20 is forced into engagement with the ratchet wheel 30 to stop the ratchet wheel 30 from counter-clockwise rotation and to allow the ratchet wheel 30 to be rotated clockwise, therefore the workpiece is rotated with the tool shaft 301 when the ratchet wheel 20 (the combination ratchet wrench) is rotated counter-clockwise. When the handle 11 is turned clockwise, the stop block 20 is moved with the handle 11 relative to the ratchet wheel 30, therefore the ratchet wheel 30 does no work, and the operation angle of the combination ratchet wrench is adjusted. By means of repeating the aforesaid procedures, the workpiece is easily fastened up or section) of the stop block 20 is inserted through the small through hole 124 in the recessed chamber 121 and then fastened with a finger plate 54.

A ratchet wheel 30 is mounted in the recessed chamber 121. The ratchet wheel 30 comprises a square tool shaft 301 raised from a bottom side thereof at the center and inserted through the circular through hole 123 in the recessed chamber 121, and a circular coupling rod 31 raised from a top side thereof near its border. A crank 40 is coupled to the circular coupling rod 31 of the ratchet wheel 30. The crank 40 has a circular coupling hole 41 at one end coupled to the circular coupling rod 31 of the ratchet wheel 30, and a constraint block 42 at an opposite end. The constraint block 42 has a smoothly curved outer side.

A cover plate 50 is covered on the recessed chamber 121 in flush with the work end 12 to hold the stop block 20 and the ratchet wheel 30 in the recessed chamber 121 within the work end 12. The cover plate 50 comprises a plurality of countersunk holes 51 respectively fastened to the screw holes 125 on the work end 12 by screws 52, and a pivot hole 53 which receives one vertical center coupling rod 23 (which has a circular cross section) of the stop block 20. When assembled, the ball 127 is loosened.

The recessed polygonal hole 13 is designed to match with the crank 40, so as to provide a variable coupling hole for grasping any of a variety of workpieces. The coupling hole is adjusted by rotating the tool shaft 301 of the ratchet wheel 30 with the hand. When the ratchet wheel 30 is rotated, the eccentric coupling rod 31 is moved to make a circular motion, thereby causing the constraint block 42 of the crank 40 to be moved with the crank 40 forwards and backwards along the inside wall of the recessed polygonal hole 13.

Figure 5B:
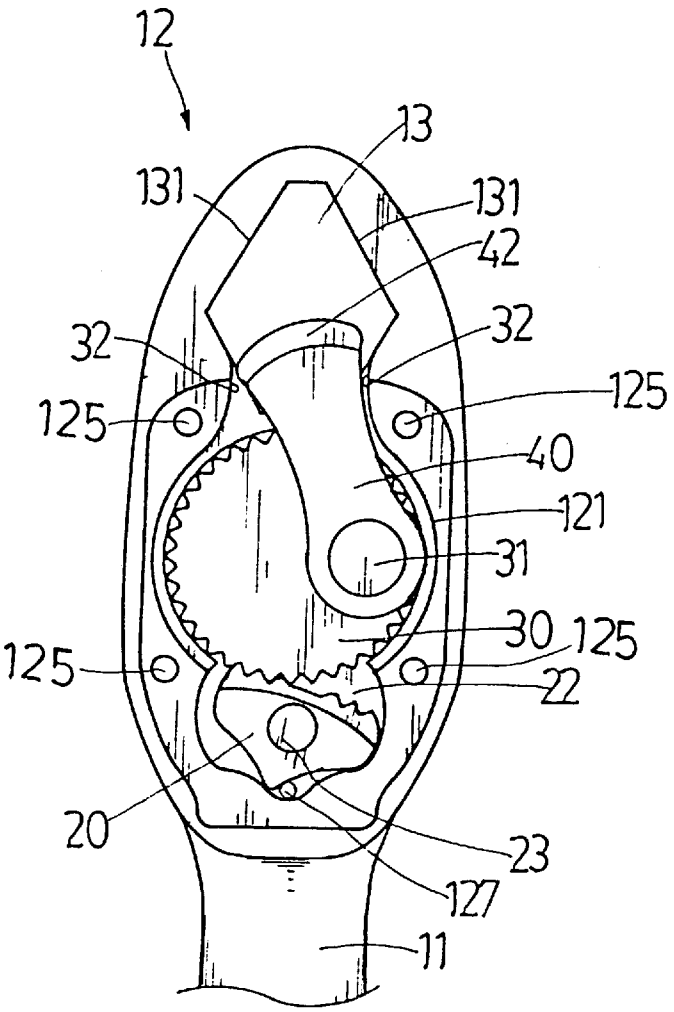
FIG. 5B is a top plain view of the present invention showing the movement of the crank (II).
Figure 5A:
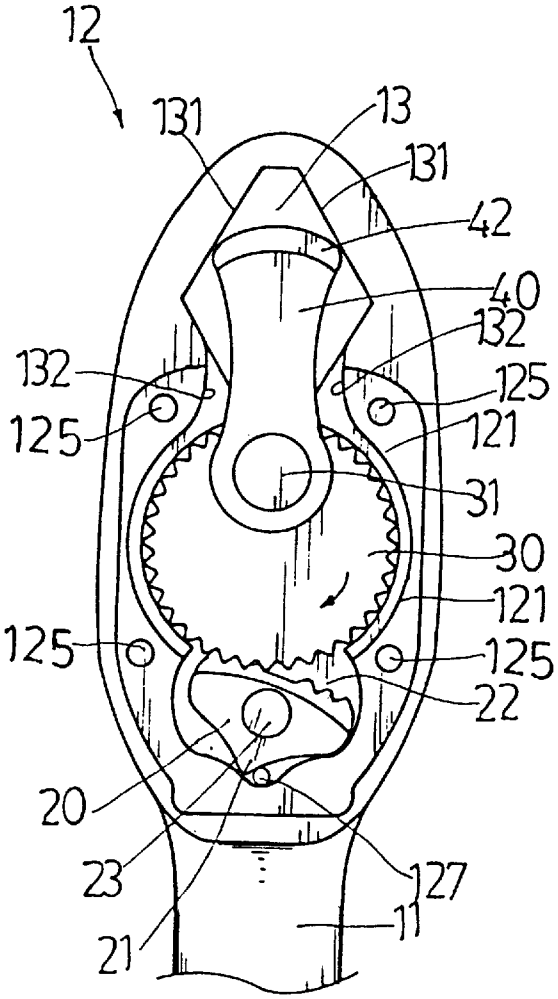
FIG. 5A is a top plain view of the present invention showing the movement of the crank (I).
Figure 5D:
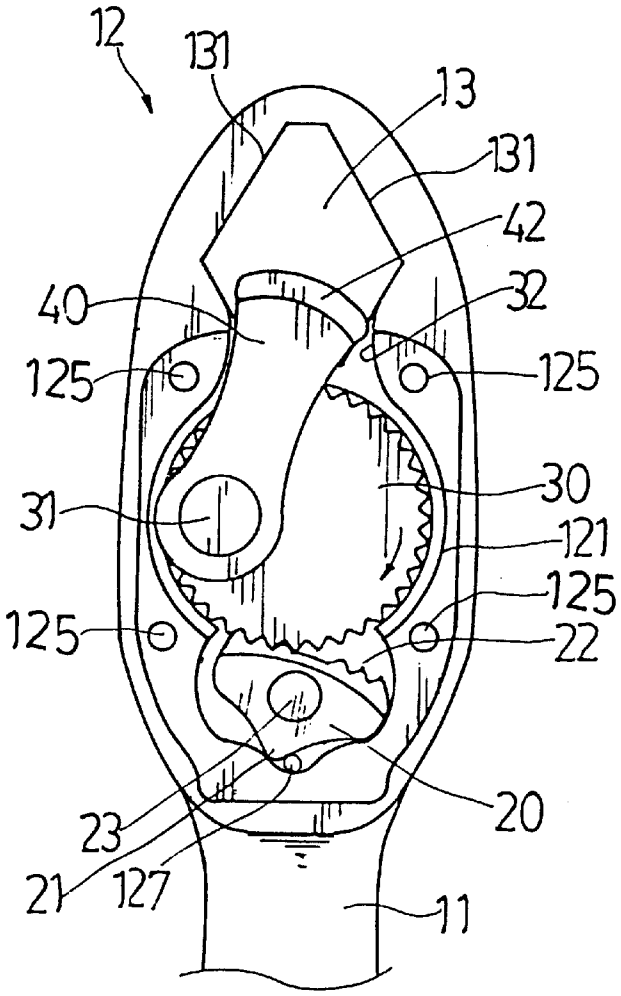
FIG. 5D is a top plain view of the present invention showing the movement of the crank (IV).
Figure 5C:
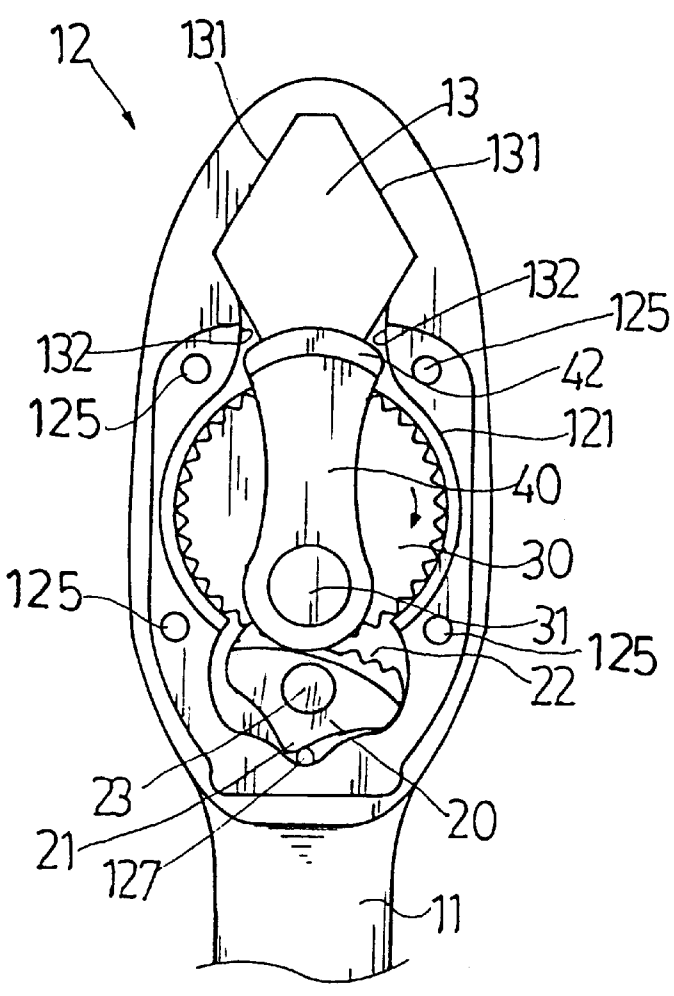
FIG. 5C is a top plain view of the present invention showing the movement of the crank (III).

When the coupling rod 31 of the ratchet wheel 30 is shifted to the front side as shown in FIG. 5A, the crank 40 is extended into the recessed polygonal hole 13 and retained in longitudinal alignment with the handle 11. When the tool shaft 301 of the ratchet wheel 30 is rotated clockwise, the ratchet wheel 30 runs idle, and the crank 40 is moved by the coupling rod 31 to change its position in the recessed polygonal hole 13 (see FIGS. 5B, 5C and 5D. When the coupling rod 31 is moved with the ratchet wheel 30 through 180° angle from the top side to the bottom side (see FIGS. 5B and 5C). During the circular motion of the coupling rod 31, the right side of the crank 40 is moved into contact with the right-sided arched side wall 132, causing the crank 40 to be tilted leftwards. When the crank 40 is tilted leftwards during the circular motion of the coupling rod 31, the constraint block 42 is moved with the crank 40 along the short side wall section of the left-sided angled side wall 131, thereby causing the crank 40 to be moved backwards along the left-sided arched side wall 132, and therefore the crank 40 is moved to the bottom side in longitudinal alignment with the handle 11 (see FIG. 5C). When the ratchet wheel 30 is continuously rotated, as shown in FIGS. 5C and 5D, the coupling rod 31 is moved from the bottom side to the top side through 180° angle. During the circular motion of the coupling rod 31, the constraint block 42 of the crank 40 is moved along the left-sided arched side wall 132, causing the crank 40 to be tilted rightwards. When the crank 40 is tilted rightwards during the circular motion of the coupling rod 31, the constraint block 42 is moved with the crank 40 along the short side wall section of the right-sided angled side wall 131, thereby causing the crank 40 to be moved forwards along the right-sided arched side wall 132, and therefore the crank 40 is moved to the top side in longitudinal alignment with the handle 11 (see FIGS. 5D and 5A).

Therefore, any workpiece 60 of which the size is within the acceptable range of the recessed polygonal hole 13 can be secured to the recessed polygonal hole 13 by the constraint block 42 of the crank 40 and turned with the combination ratchet wrench.

In additional to the aforesaid effects of the invention, the parts of the combination ratchet wrench have features designed to fit the workpiece. These features are outlined hereinafter.

Figure 7:
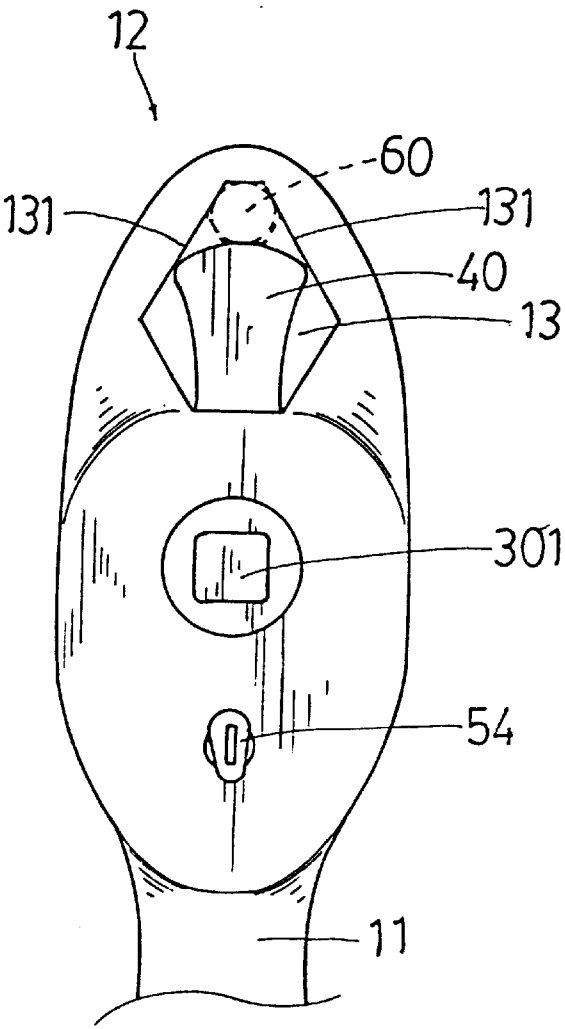
FIG. 7 is another applied view of the present invention, showing a thinner workpiece secured to the recessed polygonal hole in the work end.
Figure 6:
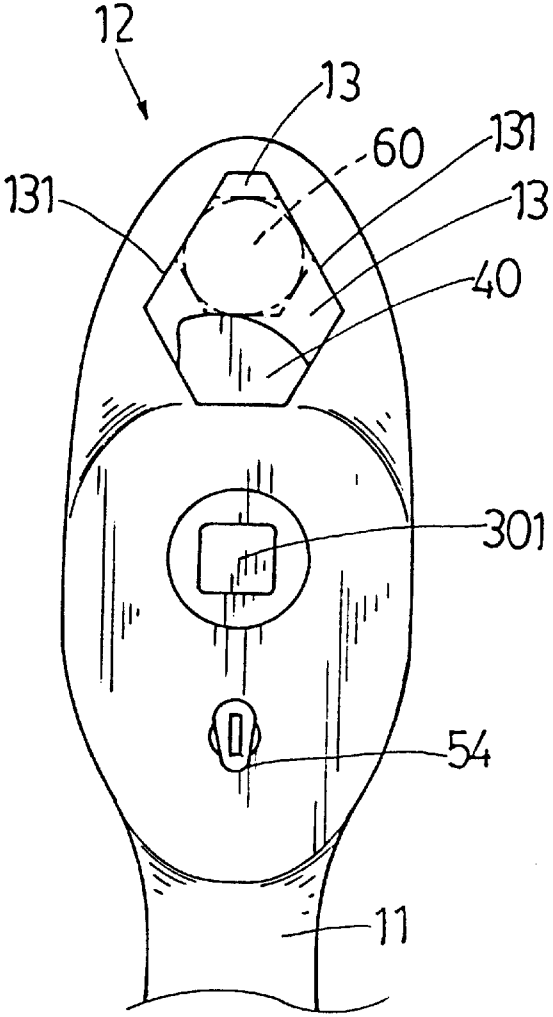
FIG. 6 is an applied view of the present invention, showing a thicker workpiece secured to the recessed polygonal hole in the work end.

1. The constraint block 42 of the crank 40 has a smoothed curved outer side for positive contact with the workpiece 60 (see FIGS. 6 and 7).

2. The constraint block 42 is raised from one end of the crank 40, and extends out of the cover plate 50. The design of the constraint block 42 increases the height of the end of the crank 40, therefore the crank 40 can positively hold down the workpiece 60 in the recessed polygonal hole 13.

3. The stop block 20 has two sets of teeth 22 for engagement with the ratchet wheel 30 alternatively, each set including at least three teeth 22 for positive engagement with the ratchet wheel 30, enabling the wrench to produce a high twisting force for turning the workpiece positively.

What the invention claimed is:

1. A combination ratchet wrench comprising a handle, a work end integral with one end of said handle, said work end defining a recessed chamber, a ratchet wheel mounted in said recessed chamber, said ratchet wheel having a tool shaft extending out of said work end, a substantially triangular stop block mounted in said recessed chamber and forced into engagement with said ratchet wheel to limit rotation motion of said ratchet wheel, said stop block having a constraint angle at a rear side thereof and a plurality of teeth at a front side therefore for engagement with said ratchet wheel, a spring mounted in a blind hole in said work end, a ball supported on said spring and stopped at one side of said constraint angle of said stop block, and a cover plate covered on said recessed chamber to hold said stop block and said ratchet wheel inside said work end, wherein:

said work end comprises a recessed polygonal hole at one side of said recessed chamber remote from said handle, said recessed polygonal hole comprising two angled lateral side walls, and two smoothly arched side walls respectively extended from said angled lateral sides toward said recessed chamber;

said ratchet wheel comprises an eccentric coupling rod raised from one side thereof opposite to said tool shaft near the border thereof;

a crank pivoted to one side of said ratchet wheel and partially projecting into said recessed polygonal hole for stopping an inserted workpiece in said recessed polygonal hole for turning, said crank comprising a constraint block at one end moved with said crank in said recessed polygonal hole for stopping the inserted workpiece in said recessed polygonal hole.

2. The combination ratchet wrench of claim 1, wherein said recessed polygonal hole has six sides of different length.

3. The combination ratchet wrench of claim 2, wherein each of said angled lateral side walls comprises a long side, and a short side connected between said long side and one of said arched side walls, said long side and said short side defining a contained angle.

4. The combination ratchet wrench of claim 1, wherein said stop block comprises two sets of teeth at the front side, each set of teeth including three teeth.

5. The combination ratchet wrench of claim 1, wherein said ratchet wheel has an eccentric coupling rod raised from one side near the border thereof opposite to said tool shaft; said crank comprises a coupling hole at one end remote from said constraint block, said coupling hole being coupled to the eccentric coupling rod of said ratchet wheel.

* * * * *